US005911188A

United States Patent [19]

Kendziera

[11] Patent Number: 5,911,188

[45] Date of Patent: Jun. 15, 1999

[54] REMOVEABLE COMPANIONWAY

[76] Inventor: David Kendziera, 700 S. Ioka, Mt. Prospect, Ill. 60056

[21] Appl. No.: 08/943,778

[22] Filed: Oct. 3, 1997

[51] Int. Cl.[6] ..... B63B 8/00

[52] U.S. Cl. ..... 114/201 R; 114/361

[58] Field of Search ..... 114/201 R, 361, 114/211, 71, 343; 160/372, 376, 377

[56] References Cited

U.S. PATENT DOCUMENTS 3,950,869 4/1976 Samarin .
4,846,089 7/1989 Cedergreen .
5,003,905 4/1991 Raynor ..... 114/201 R
5,008,435 4/1991 Lathers .
5,161,478 11/1992 Strieb ..... 114/361
5,195,445 3/1993 Riddles et al. ..... 114/361
5,568,832 10/1996 Eddy ..... 160/376

*Primary Examiner*—Stephen Avila
*Attorney, Agent, or Firm*—Roper & Quigg

[57] ABSTRACT

A removable companionway, for use in conjunction with a manufacturer-supplied door as desired depending on weather and user preference, having a frame with adjustable corner brackets to accommodate companionways of different dimensions, a cover for protection from wind, rain, and objects, and a hinge means for moving said companionway about an axis.

2 Claims, 2 Drawing Sheets

(a-a SECTION)

REMOVEABLE COMPANIONWAY

TECHNICAL FIELD

This invention generally relates to removable companionways for covering entranceways, windows, door openings, vents and the like. More particularly, for example, the invention relates to an assembly for covering a companionway of a boat cabin.

BACKGROUND ART

Access to a cabin of a boat is usually accomplished by removing a series of panels. The number of panels vary from one to six pieces depending on the boat manufacturer and the model of the boat. The panels are normally made of wood or plastic and have a storage area provided after removal of the panels. This storage area could be under a cockpit seat or near a conveniently accessible locker. The panels are normally required to secure the entrance of the boat and therefore they act as a cabin door. Locking devices are normally placed at the top panel; they usually include either a hasp or a twist barrel lock so that the top panel may be fastened to the slidable companionway above.

The panel door is made of more than one solid section and is typically mitered across the top and the bottom of each section at a downward taper toward the outside of the cabin to form an overlap to prevent water from seeping into the boat cabin. The reason for having a door made of solid plastic or wood is to provide security as well as protection from heavy foul weather. The standard sailboat paneled door which allows access to the cabin is tapered trapezoidally as viewed from the front. Such a door is wide at the top and tapers inward toward the bottom and usually has a decktop that slides forward and backward to allow head room while entering. The tapered entrance also helps the sectional door panels fit in a wedged configuration.

Consequently, an assortment of door sections having various lengths are available options. Notwithstanding this invention, the standard access to the cabin is a cumbersome effort as passing through the cabin entrance requires removing each section, stacking, and then refitting the door sections from the outside or inside of the cabin. For the above reasons, the standard panel entryway is disadvantageous.

The prior art has attempted to solve those problems by several means. For example, screens, solid one-piece latches, stretch frames as well as other devices have been used. However, experience has shown that these devices are disadvantageous for a variety of reasons. First, the prior art devices are often too large and cumbersome to be portable or readily stowable on most recreation sailboats which are typically small. Second, the prior art devices often lack the capability of being easily customized to variously shaped and sized entryway areas. Third, the prior art devices often require an installation procedure that involves drilling holes and adding supports in various areas throughout the entryway area. Fourth, the prior art devices are often so complicated that they are prohibitively expensive to the average sailboat enthusiast which defeats the manufacturer's purpose to reduce the cost of the boat by not providing an all-purpose companionway for all weather conditions. As a result, heretofore, there has been no acceptable way to avoid the difficulties described above.

The purpose of a lightweight hinged sailboat door is to simplify access to a boat cabin in a variety of weather conditions. The purpose of the invention is not necessarily to replace the standard door provided by the manufacturer of the boat; rather, the removable hinged companionway may be used in conjunction with the manufacturer-supplied door depending on the weather and the user's preference. This invention gives boat owners an optional door which is lightweight, foldable for easy storage and portability, and hinged for simple cabin access. This design is useful to any sailboat owner for several other reasons as well. First, it is important to have a screen to cover the entrance to allow for the circulation of air and the protection from insects. Second, if one is running any type of heat or air-conditioning in the cabin, one must keep the entranceway closed. Third, in the case of rain, the entranceway should be closed or sealed off for protection against foul weather.

This invention provides an important convenience for anyone living aboard a boat and for anyone who may either anchor offshore during the day or night or dock to a slip and who desires to keep out flies while being able to move in and out of the cabin without the hassle of removing and replacing a plurality of standard entranceway panels. In addition, this type of entranceway is extremely useful to a person who is sailing alone while it is raining who may need to enter the cabin quickly and return to the cockpit. However, the companionway door is not designed for use in heavy seas and extreme foul weather.

Accordingly, it is an object of this invention to overcome the aforementioned problems in the prior art.

One object of the present invention, therefore, is to provide a companionway having a particular dimension that is readily adjustable to conform to the desired application.

Another object of the present invention is to provide a companionway that is lightweight.

Another object of the present invention is to provide a companionway that is convenient and easy to install and remove from an object.

Still, another object of the present invention is to a companionway that is easy to assemble, disassemble, and package for convenient use and storage.

DISCLOSURE OF INVENTION

A removable companionway is disclosed wherein a frame may be readily and adjustably assembled in various dimensions. The frame is comprised of a plurality of rods, brackets, springs, tubes, and screws. Once the frame is assembled and adjusted to its desired dimension it may be covered by a flexible cover. The combined frame and cover can thus be used to cover entranceways having unique dimensions.

BRIEF DESCRIPTION OF DRAWINGS

For a more complete understanding of this invention, reference now should be made to the embodiment illustrated in greater detail in the accompanying drawings and described by way of example only. In the drawings.

MODES FOR CARRYING OUT THE INVENTION

While the particular embodiment of the invention illustrated in FIGS. 1 through 8 and described herein is useful for a removed companionway in a boat cabin, it will be recognized by those skilled in the art that by making alterations to the dimensions, shapes, features, and aspects of this invention, the invention is useful for other uses and objects as well.

Figure 1:
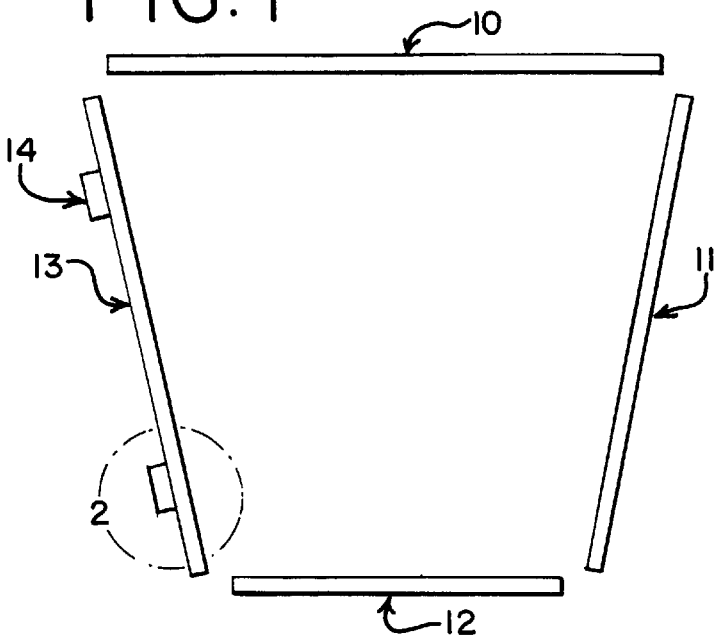
FIG. 1 is a schematic of top, side, bottom, and main frame rods.
Figure 2:
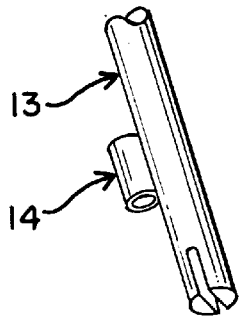
FIG. 2 is a schematic of a perspective view showing more details of the main frame rod and half hinges attached to it.
Figure 5:
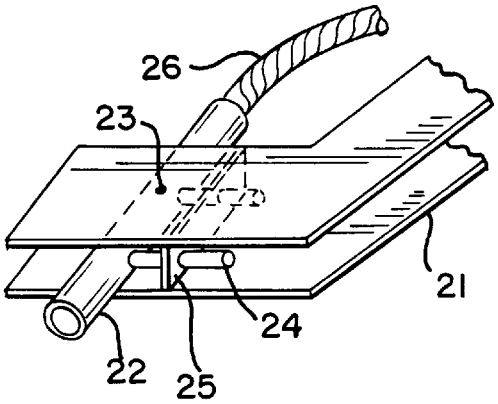
FIG. 5 is a schematic of a partial perspective view of a corner bracket.
Figure 6:
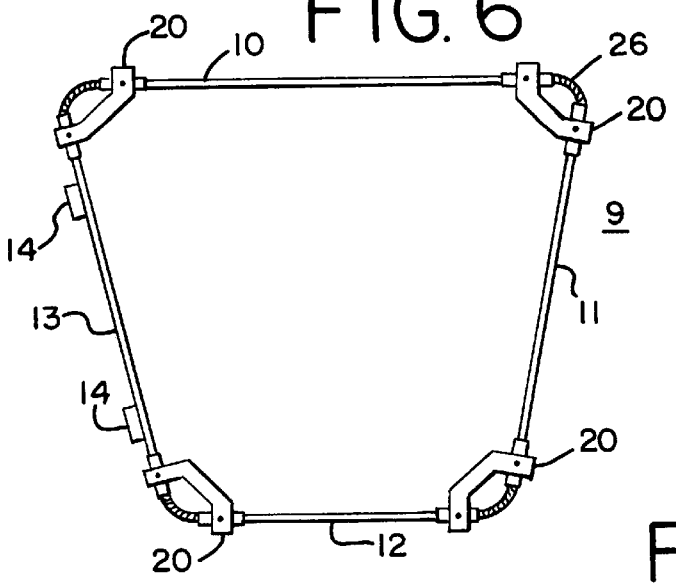
FIG. 6 is a schematic of a front view of an assembled frame.
Figure 7:
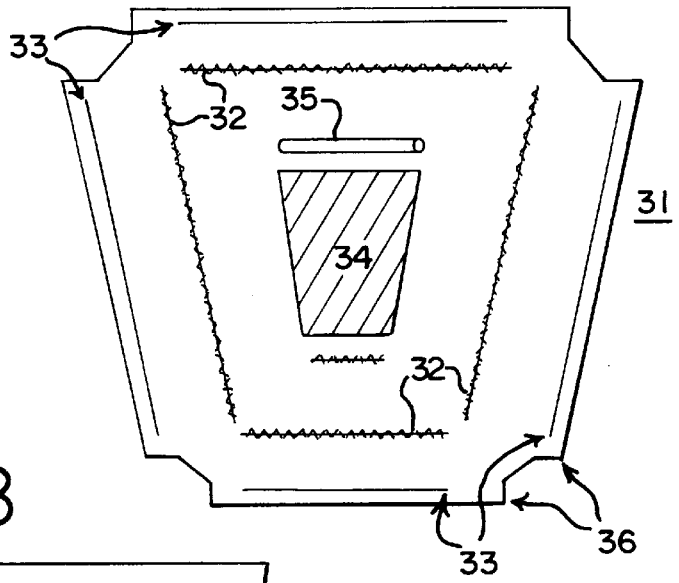
FIG. 7 is a schematic of a front view of a fabric door cover.
Figure 8:
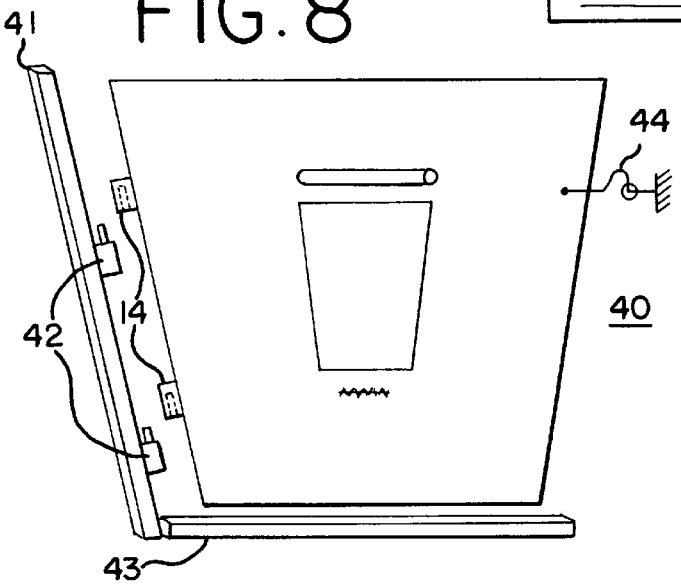
FIG. 8 shows how the assembled frame may be installed in a cabin entranceway.

FIGS. 1 through 8, show the preferred embodiment of this invention. The removable companionway comprises an assembled companionway (40) which comprises an assembled frame (9) having an adjustment means, and a door cover (31). FIG. 1 shows several elements of the preferred embodiment of the invention. A top frame rod (10), a side frame rod (11), a bottom frame rod (12), a main frame rod (13), as connected with corner brackets (20), are elements of the assembled frame (9) which is shown in FIG. 6. Both ends of each of the rods (10), (11), (12), and (13) preferably are notched for accommodating hinged pins (23) which are insertable in the rod perpendicular thereto as discussed further below. In the preferred embodiment, main frame rod (13) preferably has two hollow cylindrical half hinges (14) attached on the side and parallel to main rod (13) as shown in FIG. 2. The attachment can be by any means, preferably, for example, by welding. Each of the two half hinges (14) can be mated with side frame half hinges (42) to enable the assembled frame (9) to be affixed on a hinged basis to the cabin as shown in FIG. 8. The half hinges (14) are preferably supplied with a hole to allow another half hinge having a pin to be inserted therein. For example, the half hinges (14) are used in conjunction with side frame half hinges (42) of side frame support (41) having a pin protruding therefrom. The side frame half hinges (42) for mating with half hinges (14) are shown in FIG. 8 and said hinges (42) may be welded onto a side frame support (41) which is further affixed to the boat cabin as shown in FIG. 8.

The frame rods (10), (11), (12), and (13) may be made of any suitable materials such as, for example, fiberglass, stainless steel, etc. However, main frame rod (13) preferably is made of a material that is more rigid than the material in top frame rod (10), side frame rod (11) and bottom frame rod (12). Preferably main frame rod (13) is made of an alloyed metal so that half hinges (14) preferably may be welded thereto. FIG. 2 shows certain details of the preferred main frame rod (13). Rods (10), (11), (12) and (13) will eventually be inserted into a corner connecting tube (22) of a corner bracket (20) which is shown in FIG. 3.

In an alternative embodiment of the invention, the main frame rod (13) lacks half hinges as described below. Side (11), bottom (12), main (13) and top (10) frame rods each will have a notch at both of their ends such that the notch will fit over a tube hinge pin (23) as shown in FIG. 2 and FIG. 3. The notched-pin combination will prevent the rods (11), (12), (13) and (14) from swiveling or rotating inside corner connecting tubes (22) shown in FIG. 3.

Figure 3:
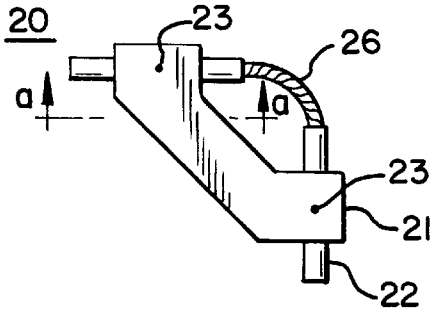
FIG. 3 is a schematic of a top view of a corner bracket.

FIG. 3 shows corner bracket (20) which comprises a main bracket member (21), corner connecting tubes (22) each of which having one tube hinge pin (23), tube pivot adjustment screws (24) and accompanying screw bracket tab (25) and perimeter spring (26). The invention preferably uses four corner brackets (20) to cover each of the four corners of the assembled companionway (40). One of the corner connecting tubes (22) is substantially horizontal when the assembled companionway (40) is installed in the cabin and is welded to a main bracket member (21). Main bracket members (21) are preferably comprised of two members preferably, for example, two stamped plates which, for example, may be made of aluminum or steel.

The vertical corner connecting tube (22) has the ability to pivot about a tube hinged pin (23). This pivoting capability helps enable the assembled companionway (40) to accommodate various shapes and sizes of various cabin entranceway openings. The horizontal tubes (22) which receive the top (10) and bottom (12) rods preferably need not be pivotable since the top and bottom of boat cabin entranceways are substantially flat and horizontal.

The pivoting of the vertical corner connecting tubes (22) works as follows. The vertical corner connecting tube (22) has two holes drilled perpendicular to and through the longitudinal center axis of tube (22) such that hinge pin (23) may be inserted inside tube (22). Hinge pin (23) is preferably made of stainless steel. This pin (23) is attached to the main bracket member (21) preferably, for example, by welding. A threaded screw tab (25) is placed inside and parallel to vertical corner connecting tube (22) and perpendicular and between the main bracket members (21). Tab (25) preferably has two threaded and tapped holes such that at least one tube and preferably two pivot adjustment screws (24) may be placed through tab (25). The tab (25) may be welded preferably, for example, at approximately one quarter of an inch from and parallel to the tube (22). Tab (25) will be welded to said main bracket member (21). Once screws (24) are inserted perpendicular through tab (25), they may be tightened or loosened such that the angle of the vertical tube (22) may be adjusted with respect to bracket (20) to accommodate rods of various lengths to accommodate various shaped cabin entranceways.

Each one of corner connecting tubes (22) preferably has a perimeter cushion spring (26) connected thereto as shown in FIG. 3 such that spring (26) preferably may adjust to the proper radius at the corner of the cabin entranceway depending on its radius of curvature. Spring (26) will also cushion the assembled companionway (40) thereby protecting the cabin entranceway from physical damage. Spring (26) is preferably made of stainless steel.

Figure 4:
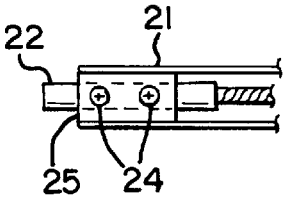
FIG. 4 is a schematic of a front view of section a—a from FIG. 3.

Hinged pins (23) are preferably one eighth of an inch in diameter and have a length comparable to or slightly longer than the diameter of said corner connecting tube (22) such that one of said pins (23) will extend across a tube (22) in a plane perpendicular to a longitudinal axis of said tube (22). FIG. 4 is a schematic which shows a view of section a—a from FIG. 3 showing the corner bracket (20). FIG. 5 shows a perspective schematic view of the corner bracket (20) such that the way to adjust the bracket (20) may be better understood as discussed herein.

FIG. 6 shows the assembled frame (9) whereby top frame rod (10), side frame rod (11), bottom frame rod (12), and main frame rod (13) are inserted in the appropriate corner connecting tubes (22) of corner brackets (20) such that the pieces are assembled in one assembly frame (9).

To assemble frame (9), corner brackets (20) preferably are arranged as follows. The corner brackets (20) are arranged such that each one of the pivoting connecting tubes (22) on each corner bracket (20) is substantially vertical for accommodating side frame rod (11) and main frame rod (13) both being of equal length. The length is chosen based on the height of the boat cabin doorway that the device is to be designed for. The ease with which side (11) and main (13)

frame rods can be replaced with different-sized rods enables one to use the same device in several different boat cabin doorways. Said rods (10), (11), (12), and (13) are prevented from axial rotation by hinged pins (23) insertable in ends of rods (10), (11), (12), and (13). Main frame rod (13) is oriented such that main frame rod half-hinges (14) face outward. After rods (10), (11), (12), and (13) have been inserted inside corner connecting tubes (22), perimeter cushion springs (26) are inserted inside the empty ends of corner connecting tubes (22) opposite to the ends having said rods (10), (11), (12), and (13) inserted thereto.

FIG. 7 shows a fabric door cover (31). Fabric door cover (31) will have a trapezoidal shape as shown in FIG. 7 such that it is compatible in shape with a boat cabin doorway; for example, it can be narrow on the bottom and taper outward in width as it goes vertically upward. The fabric door cover (31) will have four door flaps (36). Each of the door flaps (36) preferably have hook and loop fastener loop areas (33) and compatible hook and loop fastener hook areas (32) (e.g. Velcro™ brand hook and loop fastener is acceptable) such that said four door flaps (36) can be affixed thereto. Hook and loop fastener loop (33) and hook (32) areas preferably are sewn into fabric door cover (31). In a center area of fabric door cover (31) is screen area (34). Screen area (34) may be covered with a screen flap (35) which may roll down and be affixed to cover (31) using velcro as shown in FIG. 7.

Fabric door cover (31) preferably may be substantially flat and made of a flexible material. Said cover (31) may be sun and water resistant as might normally be used on sail bimini and boat covers and may be compatible therewith in color, form and function. Preferably, for example, a fabric such as SUBRELLA™ fabric is used for cover (31). Screen area (34) may allow air to circulate throughout the boat cabin while the removable companionway is closed. Alternatively, screen flap (34) may be in its closed position to prevent precipitation, wind, and insects from entering the boat cabin. Fabric door cover (31) is important because it helps to hold the entire removable companionway together. The dimension of fabric cover (31) preferably is designed to fit a particular range of entranceway dimensions as most cabins have different entranceway dimensions. In particular, due to the flexible nature of door flaps (36) as used with the loop (33) and hook (32) fastener areas which may be extra-wide or alternatively easily relocated, there is some flexibility for fabric cover (31) to fit a range of differently-sized entranceways. The fabric door cover (31) may be sized approximately one and a half inches larger than the cabin entranceway area. Since the assembled frame (9) may be adjusted to different dimensions, one assembled frame (9) can be used with one or more different door covers (31) having different dimensions.

Once the elements of the preferred embodiment are in one assembled frame (9) as shown in FIG. 6, assembled frame (9) may be placed inside fabric cover (31) which is shown in FIG. 7. First, the fabric cover (31) may be unfolded and placed on a flat surface with the side having the velcro hook areas (32) facing upward. Next, the assembled frame (9) will be placed on top of the open fabric door cover (31) and compatibly oriented. Once frame (9) is properly positioned on top of cover (31), the door flaps (36) may be affixed preferably using the hook areas (32) and loop areas (33) to fully cover the frame (9) by the fabric door cover (31). In addition, once the assembled frame (9) is placed on top of the fabric cover (31), preferably, optional mitts may be placed around the corner bracket (20) to prevent scratching the boat cabin. Next, the hook (32) and loop (33) fastener areas of the fabric cover (31) preferably may be attached by folding the flaps (36) tightly over the frame (9) and pressing the hook (32) and loop (33) areas together. Once assembled frame (9) and fabric door cover (31) are so combined, the unit can be thought of as one assembled companionway (40). The assembled companionway (40) is then a solid panel of approximately the same dimensions as the boat cabin entranceway and the standard manufacturer-supplied boat cabin door to be replaced.

Preferably, side frame support (41) shown in FIG. 8 may be slid into a channel in a boat cabin entranceway. In the preferred embodiment of the invention, once side frame support (41) is slid therein, frame support (41) can be fixed in position by using an optional removable snap pin which is passed through a hole in the entranceway channel into and through said side frame support (41) thereby adjoining the two objects. Side support (41) may be made of a aluminum rectangular rod. Bottom frame support (43) may also be accommodated by the cabin entranceway similar to the way in which the side frame support (41) is so attached.

To use the preferred embodiment in the preferred manner described above, assembled companionway (40) may be lowered down into the cabin entranceway such that the main frame rod half hinges (14) are centered with the side frame half hinges (42) on side frame support (41). Once the assembled companionway (40) is installed into side frame support (41) in such manner, assembled companionway (40) preferably may swing on said half hinges (42) such that it can swing open or closed as desired. Assembled companionway (40) preferably may also be fixed in a closed position, at the side opposite to the side having half hinges (14), or in the open position by, for example, a hooking device such as a hook (44) as shown in FIG. 8.

In an alternative embodiment, main frame rod (13) lacks half hinges and assembled frame has no need for a hook to secure assembled companionway (40). Thus assembled companionway (40) is employed by securely positioning the assembled companionway (40) into the entranceway channel of the boat that is normally used to contain the manufacturer-supplied door.

Assembled companionway (40) along with rods (10), (11), (12), and (13), flexible cover (31), as well as the other elements of the device, may easily be disassembled and stored in a small cylindrical tube. Thus, the device can be easily stored or transported for use on other boats thereby providing the user an addition degree of convenience, flexibility and space-savings.

What is claimed is:

1. A removable companionway comprising:

a frame comprising a plurality of interconnectable elements whereby said frame has an adjustment means for adjusting the dimensions of said frame; said frame comprising:

at least three rods whereby each rod has two ends;

a number of brackets equal to a number of said rods wherein one end of a first rod may be inserted in one end of a tube contained in a bracket and one end of a second rod may be inserted in second tube in said bracket; and each of said rods has a means for preventing rotation about a longitudinal axis of each of said rods with respect to said brackets: and a cover attachable to said frame whereby said cover is comprised of a piece of material enclosable around said frame.

2. A removable hinged companionway comprising:

a frame of an adjustable dimension whereby said frame comprises:

four rods whereby each rod has a first end and a second end;

four brackets whereby each of said four brackets comprises:

a main bracket member;

a first tube pivotable about an axis relative to said bracket whereby a first end of a first rod may be inserted therein; and a second tube whereby a first end of a second rod may be inserted therein; and four springs whereby each of said four springs has a first end and a second end wherein a first end is connectable to said first tube of said bracket and a second end of a spring is connectable to said second tube of said bracket;

a cover whereby said cover is a comprised of a flexible piece of material enclosable about said frame in a dimension substantially equal to a dimension of an entryway;

a hinge means whereby said frame enclosed by said cover is movable about an axis; and at least one clasp means whereby said frame enclosed by said cover may be clasped to a support.

* * * * *